US010753243B2

(12) United States Patent
Vurpillot et al.

(10) Patent No.: US 10,753,243 B2
(45) Date of Patent: Aug. 25, 2020

(54) EXHAUST COMPONENT HAVING A MAIN CASING AND A PARTIAL CASING, AND METHOD FOR MANUFACTURING SUCH AN EXHAUST COMPONENT

(71) Applicant: Faurecia Systemes D'Echappement, Nanterre (FR)

(72) Inventors: Vincent Vurpillot, Dorans (FR); David Gafforelli, Audincourt (FR); Luc Martin, Dampierre les Vois (FR)

(73) Assignee: Faurecia Systemes D'Echappement (FR)

( * ) Notice: Subject to any disclaimer, the term of this patent is extended or adjusted under 35 U.S.C. 154(b) by 287 days.

(21) Appl. No.: 15/567,665

(22) PCT Filed: Apr. 14, 2016

(86) PCT No.: PCT/EP2016/058224

§ 371 (c)(1),
(2) Date: Oct. 19, 2017

(87) PCT Pub. No.: WO2016/169834

PCT Pub. Date: Oct. 27, 2016

(65) Prior Publication Data

US 2018/0156088 A1 Jun. 7, 2018

(30) Foreign Application Priority Data

Apr. 20, 2015 (EP) ..... 15305593

(51) Int. Cl.
*F01N 1/08* (2006.01)
*F01N 13/18* (2010.01)

(52) U.S. Cl.
CPC ..... *F01N 1/089* (2013.01); *F01N 13/18* (2013.01); *F01N 2260/16* (2013.01);
(Continued)

(58) Field of Classification Search
CPC ..... F01N 1/089; F01N 13/18; F01N 2260/16; F01N 2260/18; F01N 2450/22; F01N 2490/08
(Continued)

(56) References Cited

U.S. PATENT DOCUMENTS 4,085,816 A * 4/1978 Amagai ..... F01N 13/14 180/89.2
5,281,778 A * 1/1994 Cheladyn ..... F01N 13/14 181/211
(Continued)

FOREIGN PATENT DOCUMENTS

WO 2008086513 7/2008

OTHER PUBLICATIONS

European search report dated Oct. 9, 2015.

*Primary Examiner* — Forrest M Phillips
(74) *Attorney, Agent, or Firm* — Carlson, Gaskey & Olds, P.C.

(57) ABSTRACT

An exhaust component comprises a main casing and at least one partial casing pressed against the main casing. In a developed state, the partial casing has an elongated shape along a longitudinal line and is defined along a transverse direction, substantially perpendicular to the longitudinal line, by two side edges opposite one another. The partial casing has a given developed longitudinal length. The partial casing has no fastening to the main casing on at least one longitudinal segment, and the longitudinal segment extends from one side edge to the other and extends in total over a cumulative developed longitudinal length of at least 20% of the given developed longitudinal length.

25 Claims, 4 Drawing Sheets

(52) U.S. Cl.
CPC ..... *F01N 2260/18* (2013.01); *F01N 2450/22* (2013.01); *F01N 2490/08* (2013.01)

(58) Field of Classification Search
USPC ..... 181/228
See application file for complete search history.

(56) References Cited

U.S. PATENT DOCUMENTS

| | | | | |
|---|---|---|---|---|
| 6,438,949 | B1 * | 8/2002 | Nozaki | B60K 13/04 123/184.21 |
| 6,530,443 | B1 * | 3/2003 | Tsuruta | F01N 13/08 180/89.2 |
| 7,434,656 | B2 * | 10/2008 | Yasuda | F01N 1/24 181/207 |
| 9,869,229 | B2 * | 1/2018 | Novacek | F01N 13/1805 |
| 2005/0205352 | A1 * | 9/2005 | Colin | F01N 1/06 181/249 |
| 2006/0065480 | A1 | 3/2006 | Leehaug | |

* cited by examiner

EXHAUST COMPONENT HAVING A MAIN CASING AND A PARTIAL CASING, AND METHOD FOR MANUFACTURING SUCH AN EXHAUST COMPONENT

CROSS-REFERENCE TO RELATED APPLICATIONS

This application is the US national phase of PCT/EP2016/058224, filed 14 Apr. 2016, and claims priority to EP 15305593.4, filed 20 Apr. 2015.

FIELD OF THE INVENTION

The invention generally relates to a method and apparatus that reduces acoustic dispersion in vehicle exhaust lines.

More specifically, according to a first aspect, the invention relates to a vehicle exhaust component, the exhaust component comprising a substantially tight main casing inwardly defining an exhaust gas circulation volume, and at least one partial casing pressed against the main casing, the partial casing in the developed state having an elongated shape along a longitudinal line and being defined along a transverse direction substantially perpendicular to the longitudinal line by two side edges opposite one another, the partial casing having a given developed longitudinal length.

BACKGROUND

Limiting the acoustic dispersion of exhaust lines, in particular exhaust line mufflers, is an important aspect of vehicle passenger comfort, as well as the comfort of persons in the environment of said vehicle. This acoustic dispersion primarily comes from two sources: dispersion due to gas excitation and dispersion due to structural excitation.

For exhaust components with a single-layer main casing, one of the methods traditionally used to reduce acoustic dispersion is to increase the rigidity of the main casing, which attenuates the structural excitation. Stiffening is obtained by creating ribs or bosses in the main casing. Another possibility consists of rigidly fastening a sheet on the main casing, thereby creating a local overthickness.

Furthermore, due to the thickness of the main casing, the acoustic dispersion due to gas excitation is greatly attenuated.

Equipment manufacturers in the automotive industry are always concerned with reducing the weight of components on board the vehicle. Consequently, it is desirable to reduce the thickness of the main casing. This has negative effects with respect to acoustic dispersion. Indeed, it causes strong resonances to emerge on the thin sheet. This phenomenon is in particular due to the offset of the resonance frequencies toward the low frequencies. Due to the reduced thickness, the dispersion due to gas excitation is greater, this dispersion being attenuated less through the main casing. Stiffening the main casing alone does not yield satisfactory results.

SUMMARY

In this context, the invention aims to propose an exhaust component in which the acoustic dispersion is greatly limited, even when the main casing is made up of a thin sheet.

To that end, the invention relates to an exhaust component of the aforementioned type, wherein the partial casing has no fastening to the main casing on at least one longitudinal segment, where the longitudinal segment extends from one side edge to the other and extends in total over a cumulative developed longitudinal length of at least 20% of the given developed longitudinal length, ideally at least 80% of the given developed longitudinal length.

The at least one longitudinal segment of the partial casing is free with respect to the main casing. Under the effect of the structural excitation of the exhaust component, friction thus occurs between the longitudinal segment and the main casing. This friction dampens the vibrations in the main casing of the exhaust component, and therefore reduces the noise due to structural excitation. Furthermore, the exhaust component has a wall with a high total thickness at the partial casing, which reduces the acoustic dispersion due to gas excitation.

These two aspects make it possible to reduce the overall acoustic dispersion of the exhaust component.

Advantageously, each longitudinal segment extends over a longitudinal length greater than 20% of the given developed longitudinal length.

Typically, each longitudinal segment extends over a longitudinal length greater than 50 mm, preferably greater than 80 mm, still more preferably greater than 100 mm.

Thus, the partial casing has one or several longitudinal segments that are completely free relative to the main casing, and covering a large surface area. Each longitudinal segment is capable of moving relative to the main casing in all directions, i.e., longitudinally, transversely, or among any directions forming an angle with the longitudinal and transverse directions.

The exhaust component may also have one or more of the features below, considered individually or according to any technically possible combinations:

- the main casing is a sheet with a thickness comprised between 0.2 and 1 mm, preferably comprised between 0.4 and 0.8 mm;
- each partial casing is a sheet with a thickness comprised between 0.1 and 0.8 mm, preferably comprised between 0.2 and 0.6 mm;
- the main casing is wound around a central axis, with each partial casing being arranged such that the longitudinal line is circumferential around the central axis;
- the main casing circumferentially comprises, around the central axis, at least two first faces opposite one another having a curve radius, and at least two second faces opposite one another having a second curve radius smaller than the first curve radius, each partial casing comprising at least one longitudinal segment with a first transverse width and at least one second longitudinal segment with a second transverse width smaller than the first transverse width, each first segment being pressed against one of the first faces of the main casing, each second segment being pressed against one of the second faces of the main casing;
- each first segment has no fastener to the main casing;
- the main casing has two axial edges substantially parallel to the central axis and a rigid fastener fastening the two axial edges to one another, each partial casing having two opposite longitudinal ends fastened to the main casing by said rigid fastener;
- each partial casing is a strap encircling the main casing;
- the strap includes several turns superimposed on one another;
- the strap is tightened with a tightening tension comprised between 500 N and 3500 N;
- at least one longitudinal end of the partial casing is welded on the main casing, for example the two opposite longitudinal ends of the partial casing are welded on the main casing;

the main casing has a given total surface area, the partial casing(s) having a smaller total surface area comprised between 3% and 80% of the given total surface area; and at least one partial casing has at least one flap folded and/or cut between the main casing and the partial casing.

According to a second aspect, the invention pertains to an exhaust line including an exhaust component having the above features.

According to a third aspect, the invention relates to a method for manufacturing an exhaust component as defined above, the method comprising the following steps:

laying each partial casing against the main casing;

winding the partial casing(s) and the main casing together; and fastening the two axial edges of the main casing and the two longitudinal ends of each partial casing to one another.

According to a fourth aspect, the invention relates to a method for manufacturing an exhaust component as defined above, the method comprising the following steps:

forming the main casing; and winding the strap(s) with tension, over one or several revolutions, around the main casing.

According to a fifth aspect, the invention relates to a method for manufacturing an exhaust component having the above features, the method comprising the following steps:

laying the partial casing against the main casing;

rigidly fastening one longitudinal end of the partial casing to the main casing;

winding the partial casing and the main casing together; and rigidly fastening a second longitudinal end of the partial casing, opposite the first longitudinal end, to the main casing.

According to a sixth aspect, the invention relates to a method for manufacturing an exhaust component having the above features, the method comprising the following steps:

forming the main casing, fastening a first longitudinal end of the partial casing to the main casing;

winding the partial casing around the main casing; and rigidly fastening a second longitudinal end of the partial casing, opposite the first longitudinal end, either to the main casing or to the partial casing.

BRIEF DESCRIPTION OF THE DRAWINGS

Other features and advantages of the invention will emerge from the following detailed description, provided for information and non-limitingly, in reference to the appended figures, in which.

DETAILED DESCRIPTION

Figure 1:
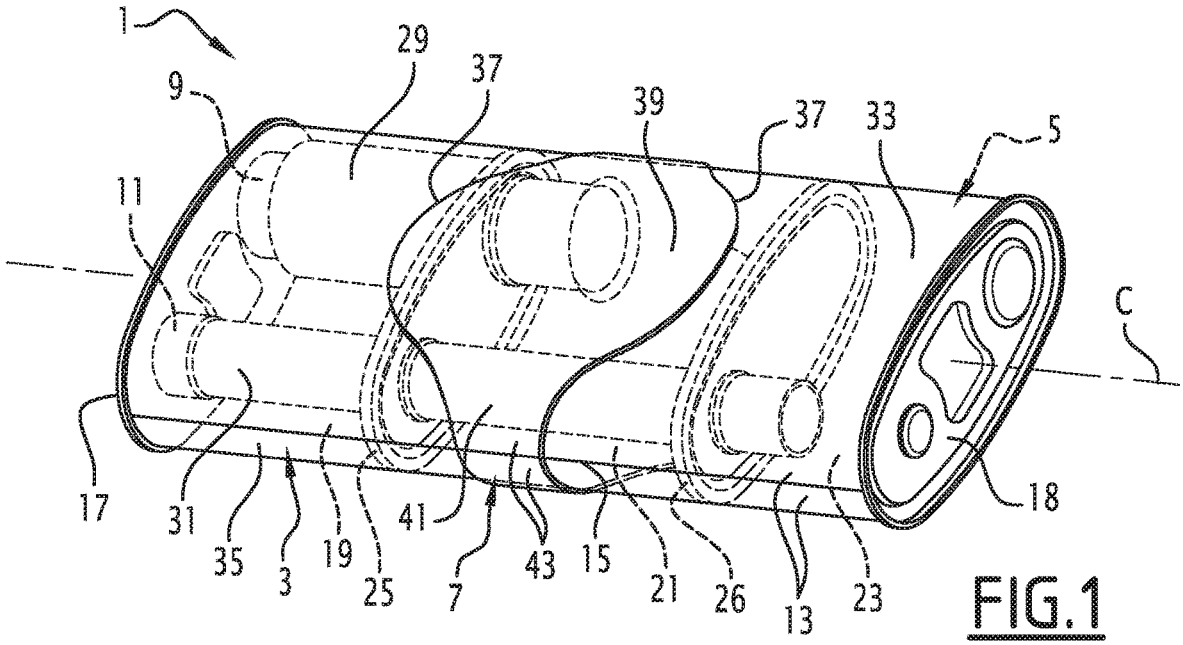
FIG. 1 is a perspective view of an exhaust component according to a first embodiment of the invention.
Figure 2:
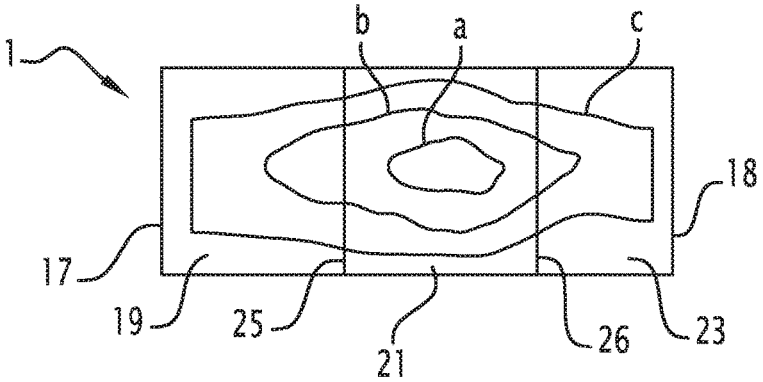
FIG. 2 is a top view of the exhaust component of FIG. 1, the main casing and the partial casing not being shown, the overall dispersed noise level (structural and gas), however, being embodied.

The exhaust component 1 shown in FIGS. 1 and 2 is a silencer, intended to be inserted in the vehicle exhaust line of a vehicle.

This vehicle is typically a motor vehicle, for example a car or truck.

Alternatively, the exhaust component is not a silencer, but an exhaust gas circulation pipe, or any other member of the exhaust line.

The exhaust component 1 shown in FIG. 1 includes a substantially tight main casing 3 inwardly defining a circulation volume 5 for exhaust gases, and a partial casing 7 pressed against the tight main casing 3.

The exhaust component 1 includes an exhaust gas intake 9 and an exhaust gas outlet 11, fluidly communicating with the volume 5. The intake 9 is fluidly connected to the upstream part of the exhaust line, and more specifically to an exhaust collector collecting the gases leaving the combustion chambers of the vehicle's engine. Typically, other equipment, such as a turbocompressor and purification equipment, is inserted between the exhaust component 1 and the exhaust collector. The outlet 9 is fluidly connected to the downstream part of the exhaust line, and more specifically, to a cannula by which the purified exhaust gases are released into the atmosphere. Typically, the exhaust gases penetrate the inside of the exhaust component 1 through the intake 9, circulating in one or several chambers arranged inside the exhaust component 1, and leave through the outlet 11.

In the example embodiment shown in FIG. 1, the exhaust component is of the wound type. More specifically, the main casing 3 is wound around a central axis C. The main casing 3 then has two axial edges 13, substantially parallel to the central axis C, extending along one another. The exhaust component 1 also includes a rigid fastener 15 for fastening two axial edges 13 to one another. For example, the fastener 15 is a crimping, or welding, or any other appropriate type of fastener.

In the illustrated example, the main casing 3, considered in cross-section perpendicular to the central axis C, inwardly has a substantially elliptical shape. Alternatively, the main casing has a circular section, like in FIG. 6, or oval, or substantially polygonal, like in FIG. 8, or any other appropriate section.

The main casing 3 has a tubular shape, and defines openings at its two opposite axial ends. The openings are closed by end cups 17, 18 rigidly fastened to the main casing 3, for example by crimping.

In the example embodiment of FIG. 1, the circulation volume 5 is divided into several chambers 19, 21, 23 by inner cups 25, 26. These cups 25, 26 extend in planes substantially perpendicular to the central axis C, and have shapes conjugated with the inner section of the main casing 3. Thus, the chamber 19 is defined between the end cup 17 and the inner cup 25, the chamber 21 is defined between the two inner cups 25, 26, and the chamber 23 is defined between the inner cup 26 and the end cup 18.

The intake 9 and the outlet 11 are arranged in the end cup 17.

In the illustrated example, an intake tube 29 is engaged in the intake 9. The intake tube 9 is parallel to the axis C, completely traverses the chamber 19, and emerges in the chamber 21.

An outlet tube 31 is engaged in the outlet 11. The outlet tube 31 completely traverses the chambers 19 and 21, and emerges in the chamber 23. Furthermore, the inner cups 25, 26 have a multitude of orifices, placing the chambers 19, 21, 23 in fluid communication.

In the illustrated example, the main casing 3 is arranged such that it comprises, circumferentially around the central axis C, two first faces 33 opposite one another having a first curve radius, and two second faces 35 opposite one another having a second curve radius smaller than the first curve radius. The two second faces 35 connect the two first faces 33 to one another.

The first faces 33 have a surface area much larger than the second faces 35. The curve radii of the first faces 33 and the second faces 35 are constant, or on the contrary are slightly variable. In any case, the curve radii of the first faces 33 still remain much larger than the curve radii of the second faces 35.

The main casing 3 is a sheet with a thickness comprised between 0.2 and 1 mm, preferably comprised between 0.6 and 0.8 mm. For example, it is made from 1.4509 steel. It is made from a single sheet in that it does not have several sheets stacked on one another.

Figure 3:
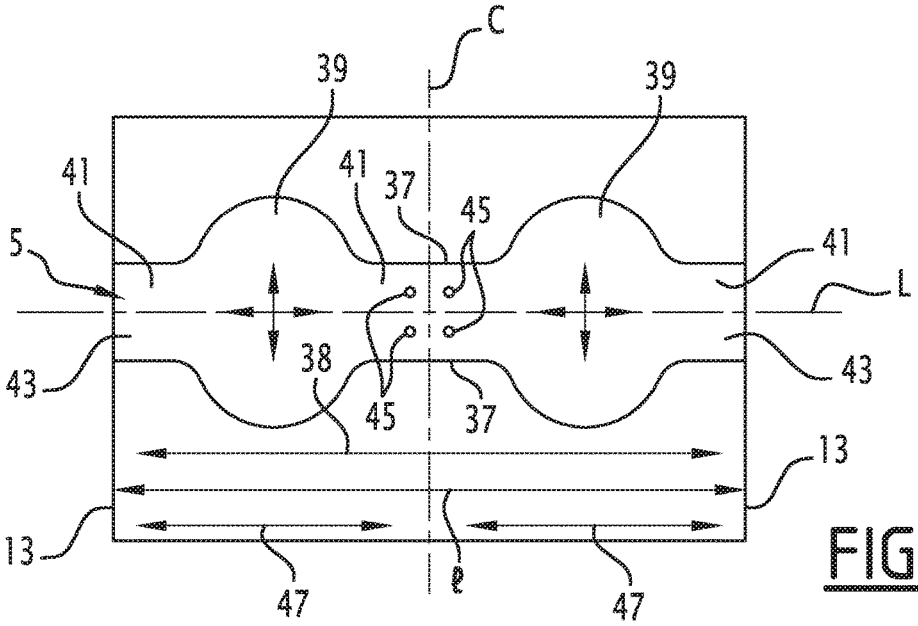
FIG. 3 is a simplified schematic illustration of the main casing and the partial casing of FIG. 1 in the developed state.

The partial casing 7, in the developed state, has a shape elongated along a longitudinal line L embodied in FIG. 3. The longitudinal line L is straight. It defines the directional along which the partial casing 7 has the largest dimension. The partial casing 7 is defined, along a transverse direction substantially perpendicular to the longitudinal line L, by two side edges 37 opposite one another. The partial casing 7 has a given longitudinal length l. This length is considered along the line L, i.e., along the longitudinal direction.

In the example shown in FIGS. 1 to 3, the side edges 37 have a sinusoidal shape. Alternatively, the side edges 37 are straight and parallel to one another, like in FIG. 6, or have any other form.

The partial casing 7 is a sheet with a thickness comprised between 0.1 and 0.8 mm, preferably comprised between 0.4 and 0.6 mm.

The partial casing 7 is made from the same material as the main casing 3, for example 1.4509 steel. Alternatively, the partial casing 7 is made from a material different from that of the main casing 3, for example 1.4510 steel.

According to the invention, the partial casing 7 has no fastening to the main casing 3 on at least one longitudinal segment 38, the longitudinal segment(s) 38 extending from one side edge 37 to the other and extending in total over a cumulative developed longitudinal length l of at least 20% of the given developed longitudinal length, preferably at least 30% of the given developed longitudinal length l, still more preferably at least 50% of the given developed longitudinal length l.

Furthermore, each longitudinal segment 38 has a developed longitudinal length greater than 20% of the given developed longitudinal length l, preferably greater than 25% or even 30% of the given developed length l.

In the example shown in FIGS. 1 to 3, the partial casing 7 is arranged such that the longitudinal line L is circumferential around the central axis C. In other words, the longitudinal line L extends in a plane perpendicular to the axis C.

Advantageously, and as shown in the figures, the partial casing 7 comprises at least one first longitudinal segment 39 with a first transverse width and at least one second longitudinal segment 41 with a second transverse width, smaller than the first width. In the example shown in FIGS. 1 to 3, the partial casing 7 comprises two first segments 39, and three second segments 41.

The partial casing 7 is arranged such that the first segments 39 are pressed against the first faces 33 of the main casing 3, the second segments 41 being pressed against the second faces 35, which have a smaller curve radius.

FIG. 2 shows three curves referenced a, b and c, defining decreasing gas excitation zones. The zone where the gas excitation is maximal, defined by curve a, is situated in the chamber 21. The first segments 39 are therefore, along the central axis C, placed at the chamber 21, so as to create a screen in the location where the gas excitation is maximal.

In the embodiment of FIGS. 1 to 3, the main casing 3 and the partial casing 7 are wound together. The two opposite longitudinal ends 43 of the partial casing 7 are rigidly fastened to the main casing by the fastener 15.

More specifically, the manufacturing method comprises the following steps:

laying the partial casing 7 against the main casing 3;

winding the partial casing 7 and the main casing 3 together; and fastening two axial edges 13 of the main casing 3 and the two opposite longitudinal ends 43 of the partial casing to one another.

Typically, the partial casing 7 remains free relative to the main casing 3 over the rest of its longitudinal length. It is fastened to the main casing 3 only by the fastener 15.

Thus, in this example embodiment, the longitudinal segment 38, which is completely free and has no fasteners to the main casing, includes the first two segments 39, the second segment 41 situated between the first two segments 39, and the largest part of the second segments 41 situated between the first segments 39 and the ends 43.

The segment 38 extends over about 90% of the developed longitudinal length l.

In one alternative embodiment, one or several second segments 41 of the partial casing 7 are rigidly fastened to the main casing 3, for example by welding spots 45, embodied in FIG. 3, in addition to the fastener 15. In the example of FIG. 3, only the segment 41 situated circumferentially opposite the fastener 15 is fastened to the main casing 3. The welding spots 45 are placed at one of the second faces 35 of the main casing 3. Along the line L, they are situated substantially at the middle of the second segment 41, which connects the first segments 39 to one another.

Alternatively, the welding spots 45 are situated on one or several other faces of the main casing 3.

In this example embodiment, the partial casing 7 includes two longitudinal segments 47 with no fasteners to the main casing. Each segment 47 extends from the welding spots 45 to one of the two longitudinal ends 43. Each segment 47 extends over about 40% of the given developed longitudinal length l. In total, the two longitudinal segments 47 extend over about 80% of the given developed longitudinal length l.

According to another alternative embodiment that is not shown, the opposite longitudinal ends 43 of the partial casing 7 are not fastened to the main enclosure by the fastener 15 making it possible to secure the axial edges 13 to one another. Each longitudinal end 43 is fastened to the main casing by a fastener specific to it, for example by welding spots or lines. The partial casing 7 may further be fastened to the main casing 3 by one or several intermediate spots situated between these two longitudinal ends 43.

In this case, the method for manufacturing the exhaust component 1 comprises the following steps:

laying the partial casing 7 against the main casing 3;

fastening one longitudinal end of the partial casing 43 to the main casing 3;

winding the main casing 3 and the partial casing 7 together; and fastening the other longitudinal end 43 of the partial casing to the main casing.

The fastening of the other end of the partial casing is done either before or after producing the fastener 15.

The exhaust component 1 may also be manufactured using the following method:

forming the main casing 3, for example by winding it;

fastening one longitudinal end 43 of the partial casing 7 to the main casing 3; and winding the partial casing 7 around the main casing 3;

fastening the other longitudinal end 43 of the partial casing 7 to the main casing 3.

Figure 8:
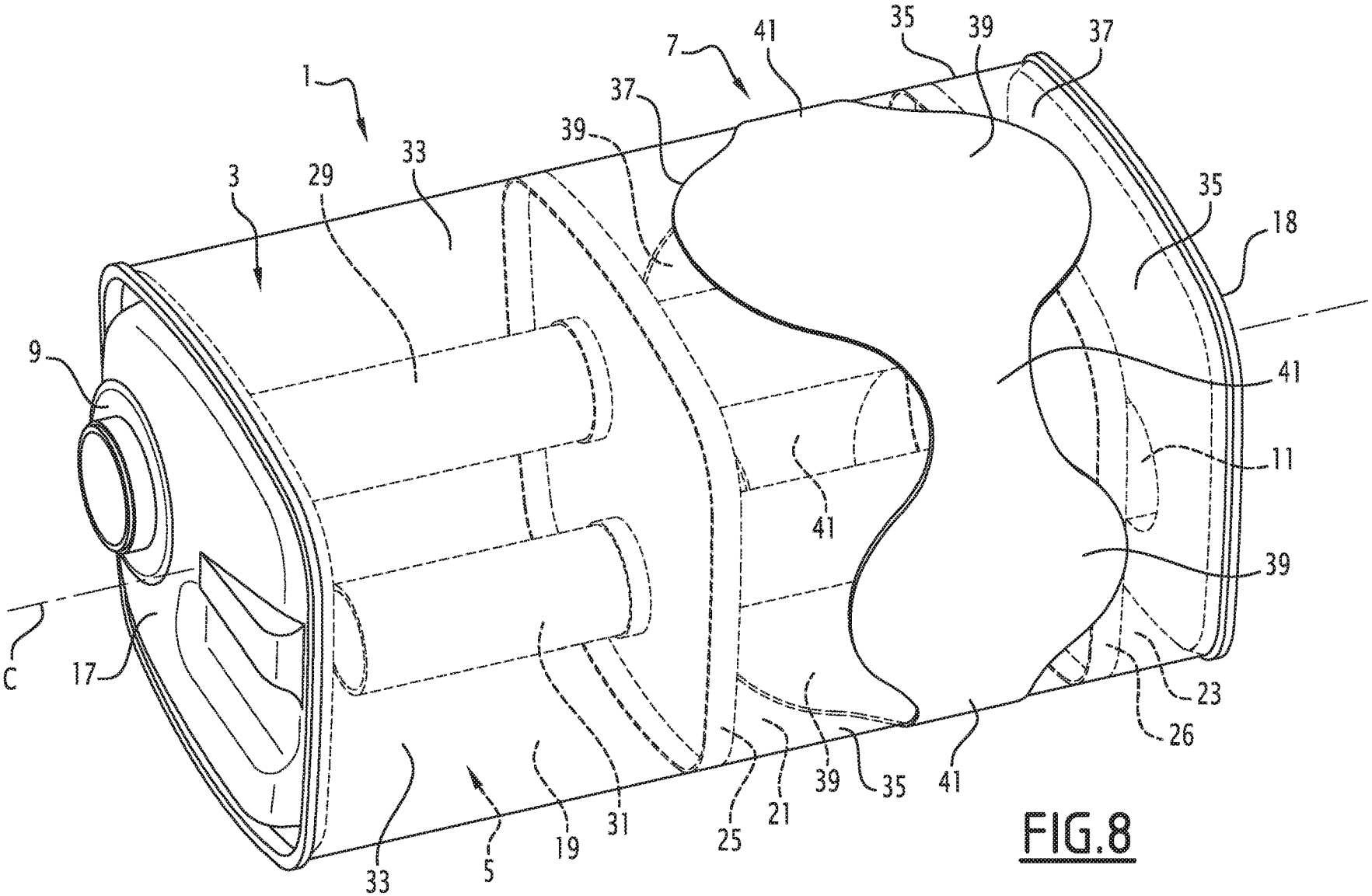
FIG. 8 shows an exhaust component according to the first embodiment of the invention, this exhaust component being an exhaust component with a design different from that shown in FIGS. 1 and 2.

FIG. 8 shows an alternative of the first embodiment of the invention. Only these points by which this alternative differs from that of FIGS. 1 to 3 will be outlined below.

In this alternative embodiment, the main casing 3 is wound so as to have, perpendicular to the central axis C, four first faces 33 having a first curve radius, connected to one another by four second faces 35 having a second curve radius smaller than the first curve radius. The first faces 33 are opposite in pairs relative to the central axis C. Likewise, the second faces 35 are opposite in pairs relative to the central axis C. Perpendicular to the axis C, the main casing 3 therefore has a rectangular general shape, with rounded corners.

In this case, the partial casing 7 preferably has four first longitudinal segments 39 with a first transverse width, and five second longitudinal segments 41 with a second transverse width smaller than the first transverse width. Each first segment 39 is pressed against one of the first faces 33 of the main casing 3. The second segments 41 are pressed against the second faces 35 of the main casing 3.

As a general rule, the partial casing 7 includes as many first longitudinal segments 39 as the main casing 3 has first faces 33, having a large curve radius.

Alternatively, the secondary casing 7 includes fewer first longitudinal segments 39 than the main casing 7 has first faces 33.

In any case, the first segments 39 still have no fastener to the main casing 3. Thus, the portions of the partial casing 7 having the largest surface area remain free to move relative to the main casing 3, which makes it possible to increase the friction between the two casings.

Typically, the partial casing 7 is fastened to the main casing 3 only by its longitudinal ends 43. Alternatively, one or several second segments 41 are rigidly fastened to the main casing 3, for example by welding spots.

In the example embodiment of FIG. 8, the exhaust gas circulation scheme inside the exhaust component 1 is different from the scheme used in FIGS. 1 to 3.

The end cup 17 bears only the exhaust gas intake 9. The outlet 11 is arranged in the end cup 18. The intake pipe 29 traverses the chamber 19 and emerges in the chamber 21. The outlet pipe 31 extends from the outlet 11 through the chambers 23 and 21, and emerges in the chamber 19. The volume of the circulation volume 5 in which the gas excitation is strongest here is also situated in the chamber 21. Thus, the segments 39 are situated, along the central axis C, at the chamber 21.

Alternatively, the situation of the exhaust gases within the exhaust component 1 may be arranged in any way. The exhaust component 1 can include any number of inner chambers, based on the desired exhaust gas circulation scheme. The area in which the gas excitation is maximal can be situated at any point of the circulation volume, 5, near one of the end cups 17, 18, or on the contrary, offset toward the center, as illustrated in FIGS. 1, 2 and 8.

Figure 4:
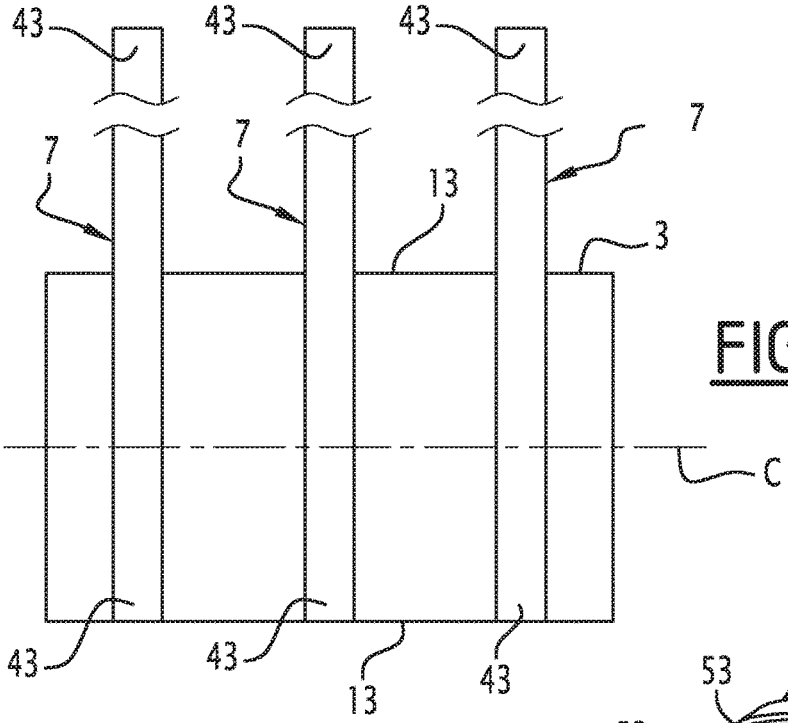
FIG. 4 is a view similar to that of FIG. 3, for a second embodiment of the invention.
Figure 5:
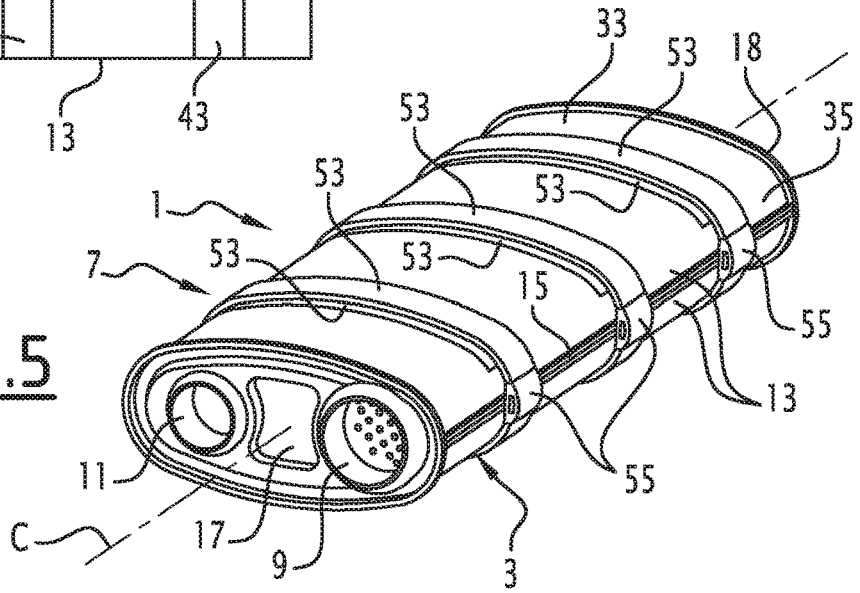
FIG. 5 is a perspective view of an exhaust component according to the second embodiment of the invention.

A second embodiment of the invention will now be described in reference to FIGS. 4 and 5. Only the differences between the second embodiment and the first will be outlined below. Elements that are identical while performing the same functions in both embodiments will be designated using the same references.

According to the second embodiment, each partial casing 7 is a strap, encircling the main casing 3. Typically, the exhaust component 1 includes several straps encircling the main casing 3, as shown in FIGS. 4 and 5.

The straps are axially spaced apart from one another, typically regularly. For example, the number of straps and the position of each strap are chosen based on tests, so as to obtain the greatest possible acoustic attenuation.

For example, each strap includes several turns 53, superimposed on one another. In other words, each strap is wound in a spiral, over several revolutions around the main casing 3, each revolution corresponding to one turn.

Preferably, each strap includes at least two turns 53, but may include three turns, four turns, or more than four turns.

In one non-preferred alternative, the strap includes a single turn.

According to one important aspect for this embodiment, the strap is tightened with a tightening tension comprised between 500 Newton and 3500 Newton. Indeed, too much tightening limits the friction between the turns or between the strap and the main casing 3. This results in a substantial decrease in vibrational energy dissipation. If the tightening tension is instead too low, the holding of the straps over time on the main casing 3 will not be good. Furthermore, this results in metal contact noises between the main casing 3 and the strap.

Typically, each strap has, along the central axis C, a width from 10 to 60 mm, typically comprised between 20 and 50 mm. For example, the width is 30 mm for each strap.

One possible method for manufacturing the exhaust component 1 is then as follows. This method comprises the following steps:

forming the main casing 3, for example by winding it; and winding the strap with tension, over one or several revolutions, around the main casing 3.

The winding of the strap around the main casing 7 is done in a traditional manner, which will not be described here.

In this case, a first longitudinal end of the strap contributes a clip 55, the second longitudinal end of the strap being engaged in the clip 55 and rigidly fastened thereto. The tensioning of the strap is done by adjusting the specific point of the second longitudinal end that will be rigidly fastened to the clip 55. The longitudinal segment of the strap that has no fastener to the main casing 3 extends over the entire developed length of the strap.

The exhaust component 1 may also be obtained using a method including the following steps:

forming the main casing 3, for example by winding it;

rigidly fastening a first longitudinal end of the strap to the main casing 3;

winding the strap around the main casing 3;

tensing the strap, and rigidly fastening the second longitudinal end of the strap either to another point of the strap itself, or to the main casing.

The longitudinal ends of the strap are, for example, fastened by welding spots or lines.

In this case, the longitudinal segment of the strap that is not fastened to the developed main casing 3 extends over at least 90% of the total developed length of the strap.

In this second embodiment, the damping of the structural excitation is done by friction of each strap on the main casing 3, and also by friction of the various turns of each strap against one another.

A third embodiment of the invention will now be described, in reference to FIG. 6. Only the differences between this third embodiment and the first will be outlined below. Identical elements or elements performing the same function will be designated using the same references.

Figure 6:
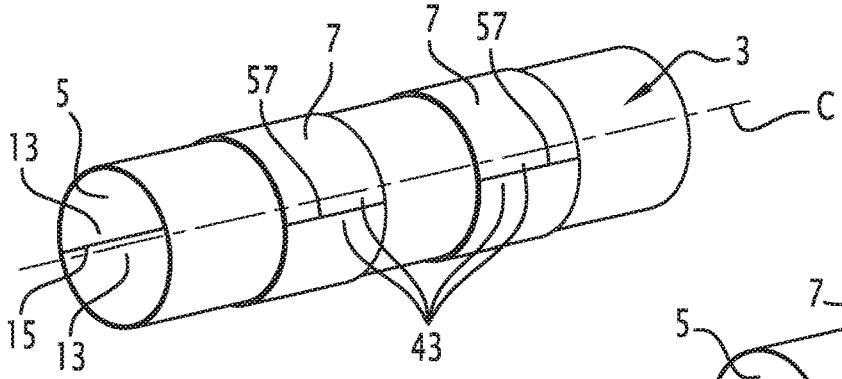
FIG. 6 is a perspective view of the main casing and the partial casing of an exhaust component according to a third embodiment of the invention.

In this third embodiment, the main casing 3 is wound and its axial edges 13 are rigidly fastened to one another by the fastener 15, which is not visible in FIG. 6.

The exhaust component 1 includes at least one partial casing 7, wound around the main casing 3. In the illustrated example, the exhaust component 1 includes two partial casings 7, substantially identical, spaced axially apart from one another. Each partial casing 7 has opposite longitudinal ends 43 rigidly fastened to one another by a connector 57. The connector 57 is of any suitable type. For example, the connector 57 is a connector by crimping, or by welding, etc.

The partial casing 7 makes only one revolution around the main casing 3. The connector 57 is circumferentially offset around the main axis C relative to the fastener 15 closing the main casing 3, typically by an angle comprised between 30° and 330°. For example, the connector 57 is diametrically opposite the fastener 15 relative to the central axis C.

The partial casing 7 does not include any rigid fastener to the main casing 3. The longitudinal segment with no fastener to the main casing 3 therefore extends over the entire length of the partial casing 7.

In FIG. 6, the main casing 3 has, perpendicular to the central axis C, a circular section. Alternatively, it has an oval, elliptical, parallelepiped, or any other appropriate section.

The method for manufacturing the exhaust component 1 is for example as follows:

winding the main casing 3 around a central axis C, and fastening two axial edges 13 of the main casing 3 to one another using a fastener 15;

winding the partial casing 7 around the main casing 3, and rigidly fastening two opposite longitudinal ends 43 of the partial casing 7 to one another by a connector 57, the connector 57 being circumferentially offset relative to the fastener around the central axis.

Figure 7:
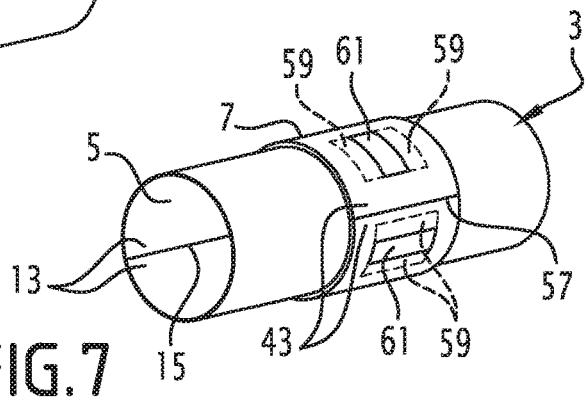
FIG. 7 is a perspective view similar to that of FIG. 6, showing an alternative embodiment of the invention.

According to an alternative embodiment shown in FIG. 7, the partial casing 7 includes at least one flap 59, folded down between the main casing 3 and the partial casing 7.

For example, an H-shaped cutout is made in the partial casing 7, and two flaps 59 are thus created and folded down between the partial casing 7 and the main casing 3. After folding of the flaps 59, a window 61 is thus arranged in the partial casing 7.

Alternatively, the cutout is C-shaped, such that each cutout of the partial casing 7 creates only one flap 59.

According to another alternative that is not shown, two parallel incisions are made on a side edge 37 of the partial casing 7, defining a flap 59 between them that may be folded down between the partial casing 7 and the main casing 3.

According to another alternative, the side edge 37 of the partial casing 7 includes a protruding area, which is bent and folded down between the main casing 3 and the partial casing 7. In this case, it is not necessary to make cutouts or incisions in the partial casing 7. This is in particular the case for the partial casing of FIG. 3, the edges of the segments 39 being able to be folded down between the partial casing 7 and the main casing 3.

The folding line connecting the flap 59 to the partial casing 7 may assume any type of orientation. As shown in FIG. 7, it may be circumferential, or parallel to the axis C, or have any other orientation.

The partial casing 7 may include one or several cutouts, as needed.

Having a flap 59 folded down between the main casing 3 and the partial casing 7 makes it possible to increase the friction surface. The thickness and stiffness of the main casing 3 are also increased locally, at the flap 59.

It should be noted that one or several flaps 59 can be made in each embodiment of the invention.

The invention has been described for an exhaust component of the wound type.

However, it also applies to exhaust components with two stamped half-shells.

Typically, the main casing 3 has a given total surface area, and the partial casing 7 has a smaller surface area, comprised between 1 and 80% of the given total surface area of the main casing 3, typically comprised between 3 and 60% of the given total surface area.

For the second embodiment of the invention, the surface area of the partial casing 7 corresponds to the cumulative surface area of all of the turns 53.

More specifically, when the partial casing 7 is a strap, the surface area of the partial casing 7 is comprised between 3 and 40% of the given total surface area. When the partial casing 7 is according to the first or third embodiment of the invention, the surface area of the partial casing is comprised between 15 and 80% of the given total surface area, preferably between 20 and 40% of the given total surface area.

Thus, the partial casing 7 covers only part of the main casing 3.

Each first longitudinal segment 39 covers between 20 and 70% of the total surface area of the first face 33 against which it is pressed, preferably between 25 and 45%. Each second longitudinal segment 41 represents between 5 and 40% of the total surface area of the second face 35 against which it is pressed, preferably between 10 and 20%. In other words, the partial casing 7 primarily covers the faces of the main casing 3 with a large curve radius, which are the least rigid. The faces with a small curve radius, which are more rigid, are less emissive, and therefore do not need to be reinforced as much as the first faces. This makes it possible to minimize the mass of the partial casing 7, and therefore of the exhaust component 1.

The partial casing 7 is typically placed toward the outside of the exhaust component 1 relative to the main casing 3. Alternatively, the partial casing is placed toward the inside of the exhaust component 1 relative to the main casing 3. It is in contact with the exhaust gases. This alternative is in particular suitable for the case where the main casing 3 and the partial casing 7 are wound together.

The invention has been described in an application with a main casing 3 having a smaller thickness, for example less than 1 mm. However, it is also applicable to the case where the main casing 3 is thicker.

As described above, the exhaust component may comprise only one partial casing. It may also alternatively include several partial casings, as illustrated in FIG. 4 or FIG. 6.

Figure 9:
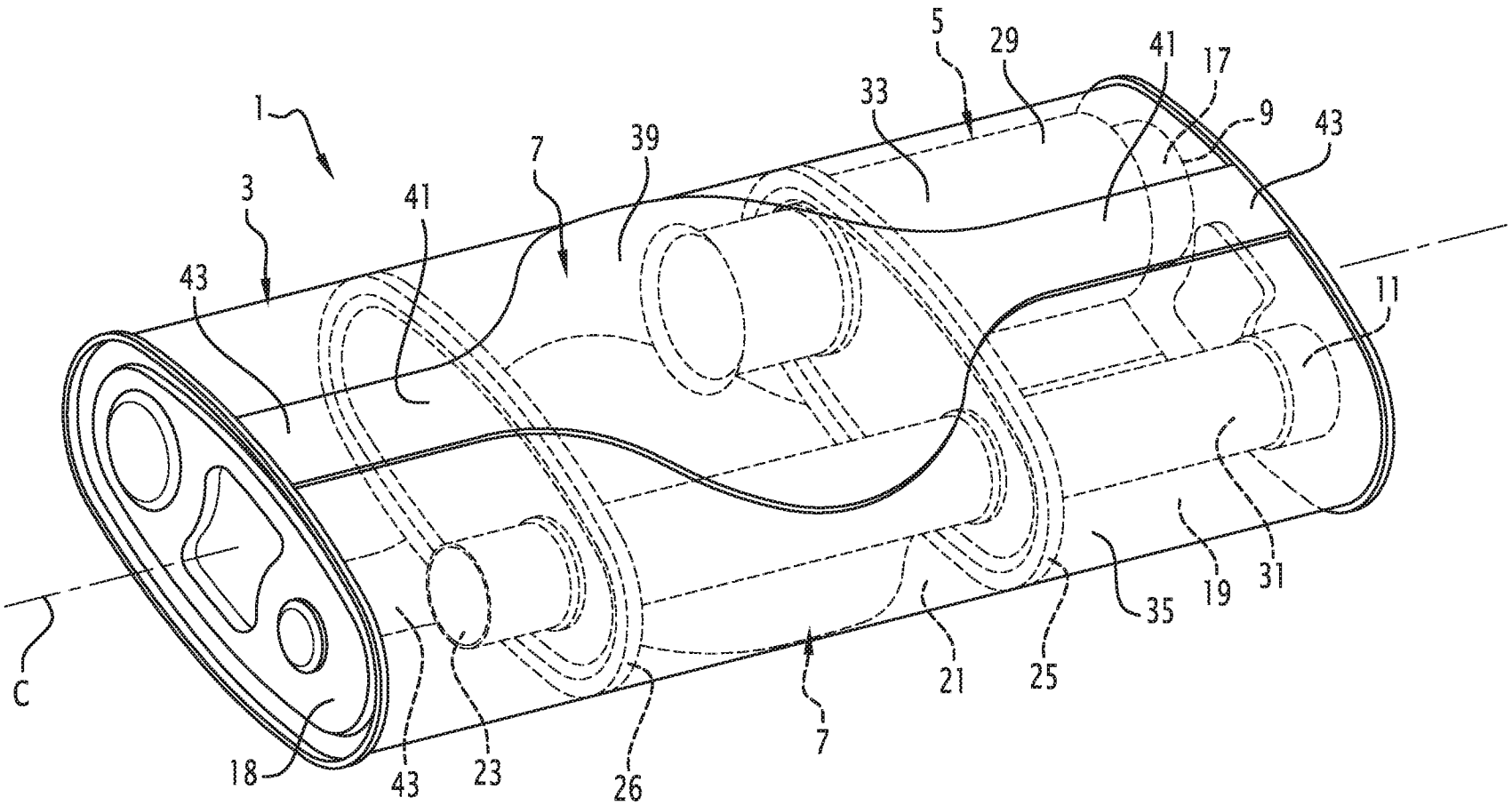
FIG. 9 is a view similar to that of FIG. 1, for an exhaust component according to the first embodiment of the invention with a partial casing oriented axially.

In the example embodiment described above, the partial casings 7 are arranged circumferentially around the central axis C of the main casing 3. Alternatively, each partial casing 7 is arranged such that the longitudinal line L is parallel to the central axis C. Such engagement is illustrated in FIG. 9, which shows an alternative of the first embodiment of the invention. Only the points by which this alternative differs from that illustrated in FIGS. 1 to 3 will be outlined below. Identical elements or elements performing the same functions will be designated using the same references.

In FIG. 9, the exhaust component 1 includes two partial casings 7, pressed against the first faces 33. Each partial casing 7 includes a single first longitudinal segment 39, extended by two second longitudinal segments 41. The longitudinal segment 39 is situated, along the central axis C, at the chamber 21, where the gas excitation level is maximal.

Each partial casing 7 extends over the entire axial length of the area. It is only fastened to the main casing 3 by its longitudinal ends 43. In the illustrated example, the longitudinal ends 43 are fastened to the main casing 3 by the fastener securing the end cups 17, 18 to the main casing 3. Alternatively, each longitudinal end 43 is fastened to the main casing 3 by a dedicated fastener, for example by welding spots.

As shown in FIG. 9, the first longitudinal segment 39 extends circumferentially over the entire width of the first face 33. On the contrary, the second longitudinal segments 41 only extend over a portion of the circumferential width of the first face 33.

The main casing 3 and/or the partial casing 7 are typically smooth. Alternatively, they are ribbed and textured.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A vehicle exhaust component comprising:

a substantially tight main casing inwardly defining an exhaust gas circulation volume;

at least one partial casing pressed against the main casing, the partial casing in a developed state having an elongated shape along a longitudinal line and being defined along a transverse direction substantially perpendicular to the longitudinal line by two side edges opposite one another, the partial casing having a given developed longitudinal length;

wherein the partial casing has no fastening to the main casing on at least one longitudinal segment, the at least one longitudinal segment extending from one side edge to the other side edge and extending in total over a cumulative developed longitudinal length of at least 20% of said given developed longitudinal length, and wherein the main casing is wound around a central axis, with each partial casing being arranged such that the longitudinal line is circumferential around the central axis;

wherein the main casing circumferentially comprises, around the central axis, at least two first faces opposite one another having a first curve radius, and at least two second faces opposite one another having a second curve radius smaller than the first curve radius, and wherein each partial casing comprises at least one longitudinal segment with a first transverse width and at least one second longitudinal segment with a second transverse width smaller than the first transverse width, each first longitudinal segment being pressed against one of the first faces of the main casing, and each second segment longitudinal being pressed against one of the second faces of the main casing; and the main casing is made from a single sheet which, in a developed state, is delimited by two axial edges opposite one another, the axial edges, once the main casing is wound around the central axis, being substantially parallel to the central axis and extending along one another.

2. The vehicle exhaust component according to claim 1, wherein each longitudinal segment extends over a longitudinal length greater than 20% of the given developed longitudinal length.

3. The vehicle exhaust component according to claim 1, wherein the main casing is a sheet with a thickness comprised between 0.2 and 1 mm.

4. The vehicle exhaust component according to claim 1, wherein each partial casing is a sheet with a thickness comprised between 0.1 and 0.8 mm.

5. The vehicle exhaust component according to claim 1, wherein each first longitudinal segment has no fastener to the main casing.

6. The vehicle exhaust component according to claim 1, wherein at least one longitudinal end of the partial casing is welded on the main casing, or wherein the two opposite longitudinal ends of the partial casing are welded on the main casing.

7. The vehicle exhaust component according to claim 1, wherein the main casing has a given total surface area, the at least one partial casing having a smaller total surface area comprised between 3% and 80% of the given total surface area.

8. The vehicle exhaust component according to claim 1, wherein the at least one partial casing has at least one flap folded and/or cut between the main casing and the partial casing.

9. The vehicle exhaust component according to claim 1, wherein the main casing has a tubular shape and defines openings at opposite axial ends.

10. The vehicle exhaust component according to claim 1, wherein the single sheet, in the developed state, is delimited by two transverse edges opposite one another and connecting the axial edges to one another, the transverse edges, once the main casing is wound around the central axis, defining said openings.

11. The vehicle exhaust component according to claim 1, wherein the main casing has a cross section, taken perpendicularly to the central axis, which is substantially constant along the central axis.

12. A method for manufacturing an exhaust component according to claim 1 comprising the following steps:

winding the main casing around the central axis, and fastening two axial edges of the main casing to one another using a fastener; and winding the partial casing around the main casing and rigidly fastening two opposite longitudinal ends of the partial casing to one another by a connector, the connector being circumferentially offset relative to the fastener around the central axis.

13. A method for manufacturing an exhaust component according to claim 1 comprising the following steps:

forming the main casing;

fastening one longitudinal end of the partial casing to the main casing;

winding the partial casing around the main casing; and fastening another longitudinal end of the partial casing to the main casing.

14. A vehicle exhaust component comprising:

a substantially tight main casing inwardly defining an exhaust gas circulation volume; at least one partial casing pressed against the main casing, the partial casing in a developed state having an elongated shape along a longitudinal line and being defined along a transverse direction substantially perpendicular to the longitudinal line by two side edges opposite one another, the partial casing having a given developed longitudinal length; and wherein the partial casing has no fastening to the main casing on at least one longitudinal segment, the at least one longitudinal segment extending from one side edge to the other side edge and extending in total over a cumulative developed longitudinal length of at least 20% of said given developed longitudinal length, and wherein the main casing is wound around a central axis, with each partial casing being arranged such that the longitudinal line is circumferential around the central axis;

wherein a rigid fastener fastening the two axial edges to one another, and wherein each partial casing has two opposite longitudinal ends fastened to the main casing by said rigid fastener; and the main casing is made from a single sheet which, in a developed state, is delimited by two axial edges opposite one another, the axial edges, once the main casing is wound around the central axis, being substantially parallel to the central axis and extending along one another.

15. A method for manufacturing an exhaust component according to claim 14 comprising the following steps:

laying each partial casing against the main casing;

winding the at least one partial casing and the main casing together; and fastening the two axial edges of the main casing and the two longitudinal ends of each partial casing to one another.

16. The vehicle exhaust component according to claim 14, wherein the main casing has a tubular shape and defines openings at opposite axial ends.

17. The vehicle exhaust component according to claim 14, wherein the single sheet, in the developed state, is delimited by two transverse edges opposite one another and connecting the axial edges to one another, the transverse edges, once the main casing is wound around the central axis, defining said openings.

18. The vehicle exhaust component according to claim 14, wherein the main casing has a cross section, taken perpendicularly to the central axis, which is substantially constant along the central axis.

19. A vehicle exhaust component comprising:

a substantially tight main casing inwardly defining an exhaust gas circulation volume; at least one partial casing pressed against the main casing, the partial casing in a developed state having an elongated shape along a longitudinal line and being defined along a transverse direction substantially perpendicular to the longitudinal line by two side edges opposite one another, the partial casing having a given developed longitudinal length;

wherein the partial casing has no fastening to the main casing on at least one longitudinal segment, the at least one longitudinal segment extending from one side edge to the other side edge and extending in total over a cumulative developed longitudinal length of at least 20% of said given developed longitudinal length, and wherein the main casing is wound around a central axis, with each partial casing being arranged such that the longitudinal line is circumferential around the central axis;

wherein each partial casing is a strap encircling the main casing; and the main casing is made from a single sheet which, in a developed state, is delimited by two axial edges opposite one another, the axial edges, once the main casing is wound around the central axis, being substantially parallel to the central axis and extending along one another.

20. The vehicle exhaust component according to claim 19, wherein the strap includes several turns superimposed on one another.

21. The vehicle exhaust component according to claim 19, wherein the strap is tightened with a tightening tension comprised between 500 N and 3500 N.

22. A method for manufacturing an exhaust component according to claim 19 comprising the following steps:

forming the main casing; and winding each strap with tension, over one or several revolutions, around the main casing.

23. The vehicle exhaust component according to claim 19, wherein the main casing has a tubular shape and defines openings at opposite axial ends.

24. The vehicle exhaust component according to claim 19, wherein the single sheet, in the developed state, is delimited by two transverse edges opposite one another and connecting the axial edges to one another, the transverse edges, once the main casing is wound around the central axis, defining said openings.

25. The vehicle exhaust component according to claim 19, wherein the main casing has a cross section, taken perpendicularly to the central axis, which is substantially constant along the central axis.

* * * * *